US009023773B1

(12) United States Patent
Richmond et al.

(10) Patent No.: US 9,023,773 B1
(45) Date of Patent: May 5, 2015

(54) FRICTION AND WEAR MANAGEMENT USING SOLVENT PARTITIONING OF HYDROPHILIC-SURFACE-INTERACTIVE CHEMICALS CONTAINED IN BOUNDARY LAYER-TARGETED EMULSIONS

(71) Applicant: The United States of America as represented by the Administrator of the National Aeronautics and Space Administration, Washington, DC (US)

(72) Inventors: Robert Chaffee Richmond, Huntsville, AL (US); Harry F. Schramm, Jr., Winchester, TN (US); Francis G. Defalco, Houston, TX (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 82 days.

(21) Appl. No.: 13/900,452

(22) Filed: May 22, 2013

Related U.S. Application Data

(60) Continuation-in-part of application No. 13/788,740, filed on Mar. 7, 2013, which is a division of application No. 13/027,472, filed on Feb. 15, 2011, now Pat. No. 8,420,582.

(51) Int. Cl.

| | |
|---|---|
| ***C09K 3/00*** | (2006.01) |
| ***B01F 3/04*** | (2006.01) |
| ***B01F 3/08*** | (2006.01) |
| ***C10M 173/00*** | (2006.01) |
| ***C07D 207/26*** | (2006.01) |
| ***C10M 135/32*** | (2006.01) |
| ***C10M 169/00*** | (2006.01) |
| ***C10M 131/12*** | (2006.01) |
| ***C10M 141/06*** | (2006.01) |
| ***C10M 141/02*** | (2006.01) |

(52) U.S. Cl.
CPC ..... *C10M 141/06* (2013.01); *C10M 141/02* (2013.01)

(58) Field of Classification Search
USPC ..... 508/157, 523; 516/11
See application file for complete search history.

(56) References Cited

U.S. PATENT DOCUMENTS

| | | | | |
|---|---|---|---|---|
| 5,540,788 | A | 7/1996 | Defalco et al. | |
| 6,455,476 | B1 * | 9/2002 | Imai et al. | 508/156 |
| 2008/0302267 | A1 | 12/2008 | Defalco | |
| 2009/0029887 | A1 * | 1/2009 | Schwab et al. | 508/283 |

* cited by examiner

*Primary Examiner* — Prem C Singh
*Assistant Examiner* — Francis C Campanell
(74) *Attorney, Agent, or Firm* — Gerald Walsh; James J. McGroary

(57) ABSTRACT

Lubrication additives of the current invention require formation of emulsions in base lubricants, created with an aqueous salt solution plus a single-phase compound such that partitioning within the resulting emulsion provides thermodynamically targeted compounds for boundary layer organization thus establishing anti-friction and/or anti-wear. The single-phase compound is termed "boundary layer organizer", abbreviated BLO. These emulsion-contained compounds energetically favor association with tribologic surfaces in accord with the Second Law of Thermodynamics, and will organize boundary layers on those surfaces in ways specific to the chemistry of the salt and BLO additives. In this way friction modifications may be provided by BLOs targeted to boundary layers via emulsions within lubricating fluids, wherein those lubricating fluids may be water-based or oil-based.

48 Claims, No Drawings

FRICTION AND WEAR MANAGEMENT USING SOLVENT PARTITIONING OF HYDROPHILIC-SURFACE-INTERACTIVE CHEMICALS CONTAINED IN BOUNDARY LAYER-TARGETED EMULSIONS

CROSS-REFERENCE TO RELATED APPLICATIONS

This application is a continuation-in-part application of U.S. patent application Ser. No. 13/788,740, filed Mar. 7, 2013, which is a divisional patent application of U.S. patent application Ser. No. 13/027,472, filed Feb. 15, 2011, which are incorporated herein by reference.

STATEMENT REGARDING FEDERALLY SPONSORED RESEARCH OR DEVELOPMENT

The invention described herein was made in part by an employee of the United States Government and may be manufactured and used by and for the Government of the United States for governmental purposes without the payment of any royalties thereon or therefor.

BACKGROUND OF THE INVENTION

1. Field of the Invention

The present invention relates to friction-reducing and/or wear-reducing modifiers and, more particularly, to a combination of aqueous salt solutions and moderately hydrophilic single phase compounds that singly or together create emulsions within base lubricating fluids, thereby increasing the anti-friction and/or anti-wear properties of those base lubricating fluids.

2. Technical Background

Some of the energy used to operate industrial equipment is devoted to overcoming internal friction and wear. Base lubricants typically are used to reduce friction and wear. Whether conventional or synthetic, these base lubricants may be enriched with friction modifiers, wear modifiers, and detergent packages. Several different friction and wear modifiers and detergent packages are currently used in motor oils, especially, and are miscible with the base lubricant. These friction and wear modifiers modify sliding and rolling friction within boundary lubrication layers between surfaces, usually metallic surfaces. For sliding surfaces this boundary layer typically is found to be a hydrodynamic boundary layer; for high-speed ball bearings this boundary layer is often found to be the elastohydrodynamic boundary layer. When lubricant base is changed out, friction and wear modifiers and detergent packages are removed as well.

Lubricants act at the boundary between two surfaces and form a layer that keeps the two surfaces apart. When the lubricant can no longer maintain separation at the boundary layer, the surfaces come into contact and relatively rapid wear and failure occurs. Lubricants have limited use in reducing friction and wear since their operational limits of performance at boundary layers are always defined; however, those limits of performance are also subject to improvements. Conversion coatings can create relatively long-lasting boundary layers and can be more effective in reducing friction. A conversion coating consisting mainly of metal may reduce friction effectively at a surface. Defalco and McCoy (U.S. Pat. No. 5,540,788) demonstrated that molybdenum, zinc, or tungsten can be deposited as a conversion coating on an iron surface when the salts of these metals are first dissolved in an inorganic phosphate polymeric water complex and then delivered in an oil lubricant vehicle to the iron surface. Furthermore, Defalco (U.S. Pat. No. 8,317,909) disclosed aqueous ionic compositions and processes for deposition of metal ions onto surfaces. The compositions form stable aqueous solutions of metal and metalloid ions that can be adsorbed or absorbed on and/or into surfaces. The aqueous solutions consist of sulfate (or phosphate) ammonium alkali metal salts with a single metal salt selected from Group I through Group VII of the periodic table of elements. An aqueous solution allows for a nano-deposition of the non-alkalai metal ions on and/or into the surfaces. The conversion coatings created by the deposited non-alkaline metal ions provide substantially reduced friction in metal-to-metal contact without the use of hydrocarbon based lubricants. These coatings include conversion coatings.

It is expected that these metal ionic solutions can be added to lubricating oils containing complex emulsifying detergents and/or dispersants, such as those contained in motor oils, and they may increase the anti-friction properties of the motor oil. However, many non-motor oil lubricants, henceforth termed gear oils, compressor oils, extruder oils, hydraulic oils, water, antifreeze, and the like do not contain the complex of emulsifying detergents and/or dispersants that are present in motor oils. It has been unknown heretofore how to produce emulsions in non-motor oil lubricants whereby those emulsions have affinity for associating with boundaries, thereby providing boundary layer organization-enhancing anti-friction and/or anti-wear properties of the base lubricants.

SUMMARY OF THE INVENTION

The present invention is a wear and/or friction reducing additive for a lubricating fluid comprising an emulsion formed within the base lubricant from a moderately hydrophilic single-phase compound and an aqueous salt solution. The present invention provides friction-reducing and/or wear-reducing additives within the emulsion particles for a lubricating fluid. The embodiment consists of a moderately hydrophilic single-phase compound combined with an aqueous salt solution consisting of ions observed to associate with metalic boundary surfaces so as to enhance anti-friction and/or anti-wear properties of base lubricants. It is required that each component of this pair of additives independently, or in combination, form an emulsion within the lubricant base. Moderately hydrophilic single-phase compounds have been embodied as castor oil, sulfonated castor oil, ethoxylated castor oil, lanolin, triethylamine, 1-octyl-3-methylimidazoliumbis-(trifluoromethylsulfonyl)imide, 1-dodecyl-3-methylimidazoliumbis(trifluoromethyl-sulfonylimide, and 1-butyl-3-methylimidazoliumbis(trifluoromethylsulfonyl)imide. The aqueous salt solutions are embodied by combining sulfuric acid or phosphoric acid, water, ammonium hydroxide, and an alkali metal hydroxide, with addition of one or more non-hydroxy metal compounds to the combination. The aqueous salt solutions may also be comprised of those salts obtained from separate acid-base reactions of sulfuric acid or phosphoric acid with ammonium hydroxide or alkali metal hydroxide, and may produce coatings, including conversion coatings, on surfaces without application of external electromotive force. These aqueous salt solutions are also embodied in combination with a solution comprised of ammonium thiosulfate, sodium sulfite, and sodium bisulfite where those three compounds are designated as "fixer". The non-hydroxy metal compounds are selected from Groups I-VII of the Periodic Table. The alkali metal hydroxide is any hydroxide of a metal selected from Group IA of the Periodic Table. The base lubricating fluid can be any non-motor oil lubricant, such as emulsion-free hydrophobic oils, hydraulic fluids, antifreeze, or water. The embodiment most commonly evaluated as the additive pair is sulfonated castor oil added with the aqueous salt solution containing compounds of boron and zinc. The emulsion produced by the aqueous salt solution(s) and the moderately hydrophilic single-phase compound(s), either alone or in combination, provide boundary layer organizers (BLO) that thermodynamically target associations between variably hydrophillic, e.g., metal, frictional surfaces, thereby enhancing the anti-friction and/or anti-wear properties of the base lubricant(s).

An advantage of the present invention is an anti-friction and/or anti-wear additive useful in lubricants with limited or absent pre-incorporated detergent packages that will deliver emulsions of aqueous salt(s) and single-phase compound(s) to hydrophilic frictional boundaries, therein modifying the boundary layer to improve anti-friction and/or anti-wear outcome. This embodiment of targeting boundary layer organizers can also be tailored to modify friction between nonmetallic surfaces or mixed metallic/nonmetallic surfaces.

Another advantage is the use of an aqueous-based wear and/or friction modifier additive in a base lubricant containing a detergent package to protect the substrate of cylinder walls, pistons, and other components, and improve the laminar flow of the lubrication medium around those components. The additive performs equally as well with or without dependence on detergents for transportation to, and interaction with, surfaces producing sliding and/or rolling friction. The additive allows for variation of pH to remain effective and allows use of certain chemicals and solvents to replace and/or complement detergents for miscibility in base oils.

Another advantage is an additive that enables mixing of differing hydrophilic molecules in a base lubricant followed then by preferential delivery to surfaces providing sliding and/or rolling friction, resulting then in organization of the hydrodynamic and/or elastohydronynamic boundary layers. This boundary layer organization subsequently protects the frictional and wear aspects of components, such as by improving life cycle via increased wear protection and/or improving power consumption via increased lubricity. This pertains both to reservoir-based emulsion targeting to boundary layers, and to direct boundary layer delivery by application of boundary layer organizers and primary lubricant directly at the boundary layer.

Another advantage is the formation of a multi-element coating on metal and/or on other surfaces, providing a lubricating layer or protecting layer. For example, in newer engines there are many parts that are partially ceramic, such as tappets, camshafts, oil pumps, piston rings and a few other parts. Aqueous-based additives of the present invention will positively affect surfaces on such ceramic surfaces for improved performance and extended life. This includes frictional surfaces on parts used in cryogenic bearings and high temperature applications.

Another advantage is that the aqueous component of the targeting emulsions is transitory via either preliminary drying of hydrophilic friction modifiers on surfaces, or via off-gassing when operating temperature of the primary base lubricant rises above the aqueous boiling point. This thermal dissipation in time may occur within a reservoir of lubricating emulsion, or it may occur specifically within the boundary layer itself (a relatively small volume), even at system cryogenic temperatures. Depletion of the aqueous phase leaves insoluble friction modifiers concentrated on tribologic surfaces. This result can also occur using solvents other than water for subsequent emulsion-based distribution of hydrophilic boundary layer organizers to tribologic surfaces.

Another advantage is that boundary layer organizers may be introduced to hydrophilic surfaces as a pure chemical, or as single- or multi-composition solutions that are prepared as emulsions within base lubricants. Boundary layer organizing solutions also may be initially applied and concentrated on tribologic surfaces, often metal, prior to delivery of primary lubrication schemes using dry lubricants, ionic liquid lubricants, greases, and the like.

DETAILED DESCRIPTION OF THE INVENTION

While the following description details the preferred embodiments of the present invention, it is to be understood that the invention is not limited in its application to the details of formation and arrangement of the components, since the invention is capable of other embodiments and of being practiced in various ways.

Attention currently is being turned toward increasing the effectiveness of lubricants in industrial equipment. These are either petroleum or synthetic oils, and the trend is to move completely toward synthetic oils. This class of base lubricants are used for a substantial proportion of industrial mechanized equipment such as compressors, extruders, and hydraulic systems, wherein lubricity and wear protection is reduced compared with motor oils, which contain aggressive additive packages of friction modifiers and detergents. The present invention combines aqueous salt solutions described by Defalco with single-phase boundary layer organizer emulsions so that these emulsions will be targeted to boundary layers wherein they increase the anti-friction and/or anti-wear properties of base lubricants used in industrial equipment.

Base lubricants in the present invention benefit from addition of emulsions containing anti-friction and/or anti-wear compounds thermodynamically favoring, i.e., "targeted" to, frictional boundary surfaces whereon those partitioned compounds interact with those boundary surfaces to organize boundary layers. This targeted boundary layer system can be formulated to emulsify directly in base lubricants even if there are no detergents present.

"Targeting" frictional boundary surfaces and layers first requires an emulsion, aqueous or not, forming within the base lubricant such that it will associate thermodynamically within boundary layers. These emulsions containing different compounds organizing boundary layers are self-forming, i.e., need not involve detergents. In summary, the current invention requires creation of emulsions within base lubricants in order to target thermodynamically a wide range of novel and/or complementary modifiers partitioned within those emulsions to frictional boundary layers.

Lubrication additives of the current invention require balanced emulsions in base lubricants, created typically with an aqueous salt solution plus a moderately hydrophilic single-phase compound such that partitioning within the resulting emulsion provides targeted compounds for boundary layer organization thus establishing anti-friction and/or anti-wear. These emulsion-directed compounds, referred to as boundary layer organizers (BLO's), energetically favor association with tribologic surfaces in accord with the Second Law of Thermodynamics, and will organize boundary layers on those surfaces in ways specific to the chemistry of the hydrophilic additive. Energetically favored delivery of boundary layer organizers to the frictional boundary surface can achieve effective total fluid replacement whereby replacement of the volume of base lubricant initially within the boundary layer achieves outcome equal to complete replacement of base lubricant with BLOs. In one embodiment this is observed using costly ionic liquids (ILs) as the single-phase compound for emulsion wherein only a small volume of ILs are required to obtain BLO effectiveness. The boundary layer may provide molecular organization upon two boundary surfaces and an associated thin layer between those surfaces. Boundary layer organization may be only on the frictional surfaces directly, and/or may extend into the small volume of the layer between these surfaces, depending on individual chemistries and partitioning of the boundary layer organizers. In this way friction modifications may be provided by BLOs targeted to boundary layers via emulsions.

The friction and/or wear reducing additives are partitioned within an emulsion typically comprised of a moderately hydrophilic single-phase compound, i.e., BLO, and an aqueous salt solution wherein the moderately hydrophilic single-phase compound is typically first emulsified by shaking and/or sonicating in base lubricant and then the aqueous salt solution is secondly added to the base lubricant and likewise emulsified. The order of this addition and emulsification may be reversed. The single-phase compound and the aqueous salt solution may at times also be added to the base lubricant simultaneously, or the single-phase compound and the aqueous salt solution may at times be mixed together and then added to the base lubricant.

Moderately Hydrophilic Single-Phase Compounds (HSPC; See Table 1)

These include, but are not limited to, sulfonated castor oil (HSPC-1), 1-octyl-3-methylimidazoliumbis(trifluoromethylsulfonyl)imide (HSPC-2), castor oil (HSPC-3), hydrated lanolin (HSPC-4), ethoxylated castor oil (HSPC-5), 1-butyl-3-methylimidazolium bis(trifluoromethylsulfonyl)imide (HSPC-6) and 1-dodecyl-3-methylimidazolium bis(trifluoromethylsulfonyl)imide (HSPC-7). HSPC-2, HSPC-6, and HSPC-7 represent imidazolium-based ionic liquids. The term "moderately hydrophilic" relates to the property of these single-phase compounds forming emulsions preferably, but not necessarily, in both water and in industrial lubricants. When a hydrophilic base lubricant such as water includes aqueous salt solutions used as friction and/or wear modifiers, it is expected that those salts will partition to an unspecified extent within those emulsions formed by moderately hydrophilic single-phase compounds for subsequent targeting to boundary layers, and/or those salts will otherwise also be provided directly from solution to those boundary layers.

The base lubricant can contain any suitable moderately hydrophilic single-phase compound, as from Table 1, providing enhanced wear and/or friction benefit. Some emulsifiers, however, can be added that do not behave as the moderately hydrophilic single-phase compounds embodied in Table 1. The complex anionic micro-emulsifier sodium bis(2-ethylhexyl)sulphosuccinate (AOT) for example, when used in conjunction with base lubricants and aqueous salt solutions, did not produce the anti-wear and/or anti-friction results achieved by the moderately hydrophilic single-phase compounds denoted in Table 1.

Aqueous Salt Solutions (AS; See Table 1)

Typically these are prepared by methods disclosed in Defalco (U.S. Pat. No. 8,317,909). In those solutions the following reactants are typically required: a) at least one water soluble non-hydroxy containing metal compound selected from Groups I-VII of the Periodic Table; b) an alkali metal hydroxide; c) a sulfur-containing compound and/or a phosphorous containing compound, such as mineral acids; d) ammonium hydroxide; and e) water. Preferably, the ionic solutions are produced when the reactants sulfuric acid or phosphoric acid, water, ammonium hydroxide and the alkali metal hydroxide are mixed together. An exothermic reaction occurs and the temperature of the aqueous solution is approximately 100° C. A measured amount of a non-hydroxy metal salt, such as, for example, boric acid, or zinc oxide, or ammonium tungstate or a combination thereof can then be introduced into the reaction vessel and dissolved. The metallic ions then become soluble in the aqueous solution and do not precipitate and remain stable. The alkali metal hydroxide can be any hydroxide of a metal in Group IA of the Periodic Table, principally sodium hydroxide, potassium hydroxide, or lithium hydroxide, with potassium hydroxide being the preferred reactant. Combinations of these alkali metal hydroxides may also be used. At times, preformed salts may be used in preparation of Aqueous Salt Solutions, rather than produced with inclusion of the exothermic reactions described above incident with reactions of acids and bases directly. This latter method of mixing preformed salts is used in production of AS-1 listed in Table 1.

The metal compounds may be from any non-hydroxy containing metal of Groups I-VII of the Periodic Table. Representative, non-limiting examples of applicable non-hydroxy water soluble metal compounds include those derived from: Group I-B: copper, silver, gold; Group II-A: beryllium, magnesium; Group II-B: zinc, cadmium; Group III-A: aluminum, gallium, indium; Group IV-A: silicon, tin, lead; Group IV-B: titanium, zirconium, hafnium; Group V-A: antimony, bismuth; Group V-B: vanadium, niobium, tantalum; Group VI-A: selenium, tellurium; Group VI-B: chromium, molybdenum, tungsten; Group VII-B: manganese; and Group VIII: iron, cobalt, nickel, palladium rhodium.

Preparation of an Aqueous Salt Solution Containing Zinc Sulfate and Boric Acid (AS-1).

This solution is comprised of 1.1 mol/L potassium sulfate and 4.3 mol/L of ammonium sulfate. The pH is adjusted to 7.0 by the addition of a small quantity of 28-30% ammonium hydroxide. To 100 mL of this solution are added 1.75 g zinc sulfate heptahydrate (or 1.0 g of anhydrous zinc sulfate) and 1.0 g of boric acid. The mixture is heated with stirring until all of the solids dissolve; upon cooling a small amount of precipitate (consisting primarily of potassium sulfate) may reform. This can be filtered off if desired; however it is not necessary. The pH is then adjusted to 9.0 using 28-30% ammonium hydroxide. This ionic solution is referred to as AS-1. A second solution was prepared in a similar fashion but the pH was 7 to 8. This second aqueous salt solution is referred to as AS-2. AS-1 and AS-2 will form coatings, such as, for example, conversion coatings, on non-alkaline metals without the use of externally applied electromotive force (see U.S. Pat. No. 8,317,909).

Preparation of an Ionic Solution Containing Ammonium Tungstate (AS-3).

Into a reaction vessel add about 1 to 3 liters, preferably about 2 liters, of water and about 0.5 to 1.5 liters, preferably about 1 liter, of concentrated sulfuric acid. Then add about 0.5 to 1.5 liters, preferably about 1 liter, of ammonium hydroxide, about 15-35%, preferably about 26%. The ammonium hydroxide must be added slowly to the sulfuric acid over a period of time sufficient to prevent a violent exothermic reaction. Preferably, the ammonium hydroxide should be added over a period of at least seven minutes or more so that the violent exothermic reaction will not occur. Then add about 0.5 to 1.5 liters, preferably about 1.0 liter, of potassium hydroxide, about 20-60%, preferably about 49%, weight/volume. Allow the liquid to cool to ambient conditions. Adjust the pH of this solution to 5 to 6. Using about 80 to 120 ml, preferably about 100 ml, of this solution add about 1-10 grams, preferably about 1 gram, of ammonium tungstate. Stir and heat until the metallic compound is completely dissolved in the solution. This aqueous salt solution is referred to as AS-3 and will also form coatings on non-alkaline metals without the use of externally applied electromotive force.

A standard Falex pin and vee-block test was used to test the anti-wear and anti-friction properties of commercially available emulsion-free lubricating oils and other fluids, without and with an aqueous salt solution, a moderately hydrophilic single-phase compound, and a combination of said solution and compound. SAE 3135 pins are placed in AISI 1137 blocks and the pins are rotated at 190 rpm. The force applied to the pins begins at 500 lbs to start the test, and is increased by 100 pounds every two minutes until the pins fail. Failure occurs when there is a rapid increase of torque (inch-pounds) that is monitored throughout the test. The longer the time to failure (TTF, minutes) and/or the lesser the torque recorded during testing, then the greater the anti-wear and/or anti-friction properties, respectively, of the lubrication composition. The aqueous salt solutions and the moderately hydrophilic single-phase compounds typically were each added to the lubricating fluid at 1 part additive to 70 parts or 140 parts lubricating fluid. This was also the case with the occasional addition of tween 60 and sodium dodecyl sulfate, both being organic-based detergents. The aqueous salt solutions and the moderately hydrophilic single-phase compounds may be combined in a ratio of 1 part to 5 parts by volume or 5 parts to 1 part by volume or in a ratio therebetween.

Tables 2-12 and Tables 15-17b and Tables 21-22 show the results of pin and vee-block testing of AS-1 alone, and AS-1 plus HSPC-1 in combination, as anti-wear and/or anti-friction additives in various base lubricants, where AS-1 includes zinc and boron and HSPC-1 is sulfonated castor oil, as specified in Table 1. Tables 8-12 also show the results of AS-1 alone, and of AS-1 and HSPC-1 combined, as anti-wear and/or anti-friction additives in various used machine lubricating oils. In testing used oils, a unit of oil (quart or gallon) was removed after more than one year of use from the machine while running, and treated nominally with 1:70 additives as done with new base lubricants.

The percent calculations in Tables 2-12 and Tables 15-22 show the percent change in time to failure (TTF) for the addition of aqueous salt solutions, and for the addition of aqueous salt solutions plus moderately hydrophilic single-phase compounds to the base lubricant. The percent change is calculated by dividing the time to failure of "oil only" into time to failure of "oil plus AS-1" or "oil plus AS-1 and HSPC-1", subtracting 1 and multiplying by 100. For Tables 2-12, the average percent increase in TTF for AS-1 in new oil was 79%±23 (mean±SE, n=11). AS-1 in new oil produced a significant increase in TTF compared to "oil only" ($p<0.05$). The average percent increase in TTF for both AS-1 and HSPC-1 in new oil was 215%±46 (mean±SE, n=11). The combination of AS-1 and HSPC-1 in new oil produced a significant increase in TTF compared to "oil only" ($p<0.05$) and compared to AS-1 in "oil only" ($p<0.05$), as shown in Table 13. TTF for AS-1 in used oil was 122%±73 (mean±SE, n=5). The average percent increase in TTF for both AS-1 and HSPC-1 in used oil was 379%±121 (mean±SE, n=11). The combination of AS-1 and HSPC-1 in used oil produced a significant increase in TTF compared to "oil only" ($p<0.05$) and compared to AS-1 in "oil only" ($p<0.05$), as shown in Table 14.

Table 5b shows the results of pin and vee-block testing with HSPC-2, HSPC-5, and AS-4 in compressor oil. HSPC-2 in oil reduced TTF. HSPC-5 produced only a 13% increase in TTF. The combination of AS-4 and the detergent tween 60 in oil increased TTF 250%. The combination of AS-4, HSPC-5, and the detergent tween 60 in oil increased TTF 263%. Tween 60 was added to the base oil at 1 part in 70 in order to establish emulsions, thus establishing the use of detergents as needed in order to establish anti-wear and/or anti-friction activity by BLOs that do not spontaneously form an emulsion in base lubricants.

Table 13 summarizes the results from Tables 2-12 regarding the addition of AS-1 or the combination of AS-1 and HSPC-1 in new (unused) oils. As noted above, AS-1 or the combination of AS-1 and HSPC-1 produced a significant increase in TTF compared to "oil only". Force at failure was significantly greater with AS-1 or AS-1 and HSPC-1 in oil compared to "oil only". Torque at the time of "oil only" failure was significantly less with AS-1 or the combination of AS-1 and HSPC-1 in oil compared to "oil only". Torque at the time of failure was significantly greater with AS-1 or the combination of AS-1 and HSPC-1 in oil compared to "oil only".

The torque and force values during the time intervals measured contribute to understanding of the lifecycle of the pin to point of failure. Practical information includes extended TTF as increased wear protection, reduced torque values as anti-friction improvement, constancy of reduced torque values during testing as reduction in parasitic loss coincident with reduced heating, and relatively high torque values during testing matched with relatively small scoring of the pin at failure as high parasitic loss coincident with excessive heating. Lifecycle is further evaluated by mechanism of failure. Scoring as the failure mode at TTF indicates small-particle third-body wear. Galling as the failure mode at TTF indicates large-particle third-body wear. Squealing as the failure mode at TTF indicates collapse of the boundary layer. Boiling as cause of failure at TTF may indicate phase changes within the boundary layer. Practical implications for mechanical components gained from lifecycle information include predictions for prolonged duty cycles (extended TTF), decreased power consumption (lowered torque values), reduced parasitic loss such as lowered vibration, drag, and heat (lowered torque values throughout significant fraction of testing), and extended lubricant life.

Table 14 summarizes the results from Tables 8-12 regarding the addition of AS-1 or the combination of AS-1 and HSPC-1 in used oils. As noted above, AS-1 or the combination of AS-1 and HSPC-1 produced a significant increase in TTF compared to "oil only". Force at failure was significantly greater with the combination of AS-1 and HSPC-1 in oil compared to "oil only". Torque at the time of "oil only" failure was significantly less with the combination of AS-1 and HSPC-1 in oil compared to "oil only". Torque at the time of failure was significantly greater with the combination of AS-1 and HSPC-1 in oil compared to "oil only".

Tables 15-20 show the results of pin and vee-block testing of the additives of the present invention in hydraulic oil. Tables 15-17a show that AS-1 in hydraulic oil or the combination of AS-1 and HSPC-1 in hydraulic oil produced an increase in TTF compared to hydraulic "oil only". Force at failure was greater with AS-1 or AS-1 and HSPC-1 in hydraulic oil compared to hydraulic "oil only". Torque at the time of hydraulic "oil only" failure was less with AS-1 or the combination of AS-1 and HSPC-1 in hydraulic oil compared to hydraulic "oil only". Torque at the time of failure was greater with AS-1 or the combination of AS-1 and HSPC-1 in hydraulic oil compared to hydraulic "oil only". The combination of AS-1 and HSPC-1 had greater anti-friction efficacy in hydraulic fluid than AS-1 alone. In addition to these improvements in pin-lifecycle, as detailed above for use in machine oil, these results show that AS-1 and the combination of AS-1 and HSPC-1 in hydraulic fluid make hydraulic fluid greatly more useful as a lubricant. A common complaint in the industry is that hydraulic fluids are often times poor lubricants, accounting for subsequent substantial damage to mechanical components.

The results of testing a variety of BLOs in MilSpec 83282 hydraulic fluid are shown in tables 17a-20. Tables 17a and 17b show that AS-1 plus HSPC-2 or HSPC-3 or HSPC-7 or AS-4 all produce substantial increases in the lubricating anti-wear and/or anti-friction usefulness of the hydraulic fluid. Table 18 shows that AS-2 plus HSPC-4 produces increases in the anti-wear and/or anti-friction properties of the hydraulic oil. Table 19 shows that AS-3 plus sodium dodecyl sulfate, a detergent used to promote an emulsion, produces increases in the anti-wear and/or anti-friction properties of the hydraulic oil. Table 20 shows that HSPC-1, HSPC-2, HSPC-5, and HSPC-7 alone produce little or no increase in the anti-wear properties of hydraulic oil, but do provide anti-friction benefit, i.e., low torque values, throughout the incremental force range.

Table 21 shows the results of adding AS-1 or the combination of AS-1 and HSPC-1 to antifreeze (Supertech from Walmart). Antifreeze by itself has no appreciable lubricating anti-friction properties. Addition of AS-1 to antifreeze imparted lubricating properties to the antifreeze. Addition of the combination of AS-1 and HSPC-1 to the antifreeze produced further increases in both anti-wear and anti-friction properties of the antifreeze. Whereas anti-wear in this combination is improved to a degree comparable with the best results in base oils, the torque values remain high compared to results from base oils or hydraulic fluids, indicating parasitic loss in the form of heat. Clearly, effective total replacement of boundary layer by these BLOs is being approached in antifreeze, but antifreeze itself is involved also in the boundary layer composition causing some relative increase in friction, i.e., increased torque values. This statement is reinforced by comparing results using the same BLOs in water as the base lubricant, as shown in Table 22, where greater improvements in pin lifecycle are observed, most notably the reduced torque values compared to antifreeze as the base lubricant thus indicating better effective total replacement of boundary layer by these targeted BLOs.

Table 22 shows the results of adding AS-1 or the combination of AS-1 and HSPC-1 to deionized water. Deionized water by itself is a relatively poor base lubricant. Addition of AS-1 to deionized water imparted no additional lubricating properties to the deionized water. However, addition of the combination of AS-1 and HSPC-1 to deionized water established an emulsion and imparted remarkable increases in lubricating properties. These results support both partitioning of the salts of AS-1 into the single-phase emulsion formed in water by the moderately hydrophic HSPC-1, and subsequent effective total replacement of the boundary layer by this targeted emulsion. HSPC-6 plus the detergent tween 60, used to establish an emulsion, also produced remarkable increases in lubricating properties; the detergent tween 60 added by itself provided no significant anti-wear value.

The usefulness of the Supertech antifreeze with addition of AS-1 and HSPC-1 (1:70) was tested in a new 4-cycle Weedeater 4.5 HP push lawn mower. The oil reservoir of the lawn mower was filled with the Supertech antifreeze treated 1:70 with each of AS-1 and HSPC-1. A total of 4 lawn cuttings were performed with the lawnmower, with each cutting lasting about one hour. The lawnmower performed normally during the 4 hours of lawn mowing, with no failures or problems occurring with the lawnmower. This experiment was also conducted with the Supertech antifreeze diluted 50% with water before adding 1:70 of the AS-1 and HSPC-1. During 4 one-hour cuttings the lawnmower performed normally, with no failures or problems occurring with the lawnmower. At the end of each cutting, however, the volume of lubricant had decreased by 15%, presumably due to evaporation of water caused by the high temperature achieved in the engine during cutting. That volume was then replaced with the original lubricant emulsion prior to the next cutting.

The emulsions created in the base lubricant by the emulsifiers and the aqueous salt solutions are preferentially delivered, i.e., thermodynamically targeted, to frictional boundary surfaces and enhance boundary layers thereon and/or therebetween. This occurs particularly at hydrophilic metal boundary surfaces, thereby improving anti-wear and/or anti-friction at these boundaries. A lubricant emulsion comprising a range of hydrophilic/hydrophobic properties can be partitioned and thermodynamically associated with, i.e., targeted to, boundary layers for purpose of improvement of wear and/or friction. Hydrophilic solvent systems, such as aqueous solutions, can be created as emulsions within hydrophobic lubricants, such as base oils, where those solvent systems contain lubricating compounds, which are targeted to relatively hydrophilic boundary layers. In the case where hydrophobic oils comprise the base lubricants, aqueous emulsions were prepared within the base oils that then delivered hydrophilic salts, such as those in AS-1, to metallic boundary surfaces, thereby achieving anti-wear and/or anti-friction improvements. In the case where these emulsions were further modified with moderately hydrophilic single-phase compounds, such as HSPC-1, a partitioned emulsion was achieved that further enhanced targeted anti-wear and/or anti-friction properties. This partitioned emulsion system further organized the boundary layer to achieve additional anti-wear and/or anti-friction improvements.

A primary difference between oil-based lubrication and water-based lubrication is that untreated oil alone can be a useful lubricant, whereas water alone is not a useful lubricant in machines. Further, aqueous salt solutions found to be useful as emulsions in oil are not as useful when provided alone to boundary layers derived from water. However, a number of moderately hydrophilic single-phase compounds were found to form emulsions then enhancing lubrication in water, and these were further improved when partitioned with aqueous salt solution comprised for effectiveness in hydrophobic base oils. These comparative embodiments make it clear that effective total replacement of boundary layers by BLOs can be approached via targeted emulsions. The usefulness of effective total replacement is that a small amount of material, such as expensive ionic liquids, embodied as HSPC-2, HSPC-6, and HSPC-7, can be applied effectively through emulsions to greatly impact lubrication performance at a boundary layer. Effective total replacement does not exclude beneficial elements of the base oil in that partitioning of those oils and associated additive packages into the targeted emulsions can also occur, depending on the emulsion system constructed.

The foregoing description has been limited to specific embodiments of this invention. It will be apparent; however, that variations and modifications may be made by those skilled in the art to the disclosed embodiments of the invention, with the attainment of some or all of its advantages and without departing from the spirit and scope of the present invention. A fundamental concept of the present invention is employment of the equilibrium achieved by thermodynamic delivery of emulsions, with their variable compositions, for enhancing the lubrication of a base lubricant. The base lubricant itself is not required to be hydrophobic oil, nor is the emulsion required to be comprised of hydrophilic solvent, solution, or mixture thereof relative to the hydrophobic base lubricant. The base lubricant could itself be hydrophilic with the emulsion comprised of BLOs being relatively hydrophobic by virtue of having formed an emulsion within the hydrophilic base lubricant. Thermodynamic targeting of boundary layer organizers in emulsions to a boundary layer can thus proceed from either hydrophobic base lubricants (oils, oil-based solutions as with oils containing commercially blended additive packages), or from hydrophilic base lubricants (water, water-based solutions comprised of solutes or solvent mixes such as antifreeze solutions, other hydrophilic solvents and/or solvent mixes including alcohols such as antifreezes, dodecenol etc., and aprotic solvents such as DMSO etc.). In a preferred embodiment both the moderately hydrophilic single-phase compound sulfonated castor oil (HSPC-1) and the aqueous salt solution AS-1 form emulsions in both oils and in water, indicating them to be boundary layer organizers midway between the hydrophobicity of typical base-oils and the hydrophilicity of water. In both cases the emulsions are seen to enhance anti-wear and/or anti-friction in pin & vee-block tests. Indeed, in water, a rather poor lubricant, the emulsion system of sulfonated castor oil and aqueous salt solution comprised of AS-1 was demonstrated to transform water to one of the best lubricants so far tested. Other moderately hydrophilic single-phase compounds, such as the ionic liquids embodied here, may be used separately or in combination to form effective BLOs in both oil-based and water-based lubricants within the scope of the present invention. This serves to introduce a myriad of new additives for lubricant improvement.

The combination of moderately hydrophilic single-phase compounds and aqueous salt solutions of the present invention being used to create boundary layer-targeted emulsions will improve the anti-wear and/or anti-friction properties of most lubricating fluids, with or without the presence of detergents.

It will be understood that various changes in the details, materials, and arrangements of the compositions which have been described and explained above in order to convey the nature of this invention may be made by those skilled in the art without departing from the principle and scope of the invention as recited in the following claims.

TABLE 1

| Hydrophilic Single Phase Compounds (HSPC) | |
|---|---|
| Designation | Compound |
| HSPC-1 | Sulfonated castor oil (ionic liquid) |
| HSPC-2 | 1-octyl-3-methylimidazoliumbis(trifluoromethylsulfonyl)-imide (ionic liquid) |
| HSPC-3 | Castor oil |
| HSPC-4 | Hydrated lanolin |
| HSPC-5 | Ethoxylated castor oil |
| HSPC-6 | 1-butyl-3-methylimidazoliumbis(trifluoromethylsulfonyl)-imide (ionic liquid) |
| HSPC-7 | 1-dodecyl-3-methylimidazoliumbis(trifluoromethylsulfonyl)-imide (ionic liquid) |
| **Aqueous Salt Solutions (AS)** | |
| Designation | Description |
| AS-1 | Sulfate based; containing zinc and boron; pH 9.0-9.1; specific gravity 1.15-1.18. |
| AS-2 | Sulfate based; containing zinc and boron; pH 7.0-8.0 |
| AS-3 | Sulfate based; containing tungsten; pH 5.0-6.0. |
| AS-4 | Photographic Fixer; containing sodium bisulfite, sodium thiosulfate, and sodium sulfite. |

TABLE 2

| Lubemaster ISO 150 Gear Oil Torque (inch-pounds) | | | | |
|---|---|---|---|---|
| Min | Force lbs | Oil only | Plus AS-1 | Plus AS-1 and HSPC-1 |
| 30 | 1900 | | | |
| 29 | 1900 | | | |
| 28 | 1800 | 0% | 20% | +20% |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |
| 20 | 1400 | | | |
| 19 | 1400 | | | |
| 18 | 1300 | | | |
| 17 | 1300 | | | |
| 16 | 1200 | | | |
| 15 | 1200 | | | |
| 14 | 1100 | | | |
| 13 | 1100 | | | |
| 12 | 1000 | | | 24/Ga |
| 11 | 1000 | | | 24 |
| 10 | 900 | 25/Ga | | 23 |
| 9 | 900 | 24 | | 23 |
| 8 | 800 | 22 | 20/Ga | 21 |
| 7 | 800 | 22 | 20 | 22 |
| 6 | 700 | 20 | 17 | 19 |
| 5 | 700 | 20 | 17 | 20 |
| 4 | 600 | 18 | 15 | 17 |
| 3 | 600 | 18 | 16 | 17 |
| 2 | 500 | 16 | 14 | 14 |
| 1 | 500 | 16 | 15 | 14 |

Ga = Gall Failure

TABLE 3

| Terresolve Envirologic 210 80W-90 Gear Oil Torque (inch-pounds) | | | | |
|---|---|---|---|---|
| Min | Force lbs | Oil only 0% | Plus AS-1 +29% | Plus As-1 and HSPC-1 +114% |
| 30 | 1900 | | | 33/Sc |
| 29 | 1900 | | | 34 |
| 28 | 1800 | | | 30 |
| 27 | 1800 | | | 32 |
| 26 | 1700 | | | 30 |
| 25 | 1700 | | | 32 |
| 24 | 1600 | | | 30 |
| 23 | 1600 | | | 31 |
| 22 | 1500 | | | 29 |
| 21 | 1500 | | | 29 |
| 20 | 1400 | | | 27 |
| 19 | 1400 | | | 27 |
| 18 | 1300 | | 28/Sc | 25 |
| 17 | 1300 | | 27 | 26 |
| 16 | 1200 | | 24 | 25 |
| 15 | 1200 | | 24 | 25 |
| 14 | 1100 | 23/Ga | 23 | 24 |
| 13 | 1100 | 23 | 23 | 24 |
| 12 | 1000 | 21 | 23 | 23 |
| 11 | 1000 | 21 | 23 | 23 |
| 10 | 900 | 20 | 21 | 21 |
| 9 | 900 | 20 | 22 | 21 |
| 8 | 800 | 19 | 22 | 18 |
| 7 | 800 | 19 | 23 | 19 |
| 6 | 700 | 17 | 20 | 16 |
| 5 | 700 | 17 | 20 | 16 |
| 4 | 600 | 15 | 18 | 14 |
| 3 | 600 | 15 | 19 | 14 |

TABLE 3-continued

| Terresolve Envirologic 210 80W-90 Gear Oil Torque (inch-pounds) | | | | |
|---|---|---|---|---|
| Min | Force lbs | Oil only 0% | Plus AS-1 +29% | Plus As-1 and HSPC-1 +114% |
| 2 | 500 | 14 | 17 | 13 |
| 1 | 500 | 14 | 18 | 13 |

Ga = Gall Failure
Sc = Score Failure

TABLE 4

| Spirax 80W-90 Gear Oil Torque (inch-pounds) | | | | |
|---|---|---|---|---|
| Min | Force lbs | Oil only | Plus AS-1 | Plus AS-1 and HSPC-1 |
| 30 | 1900 | | | |
| 29 | 1900 | | | |
| 28 | 1800 | 0% | +50% | +150% |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |
| 20 | 1400 | | | 32/Sc |
| 19 | 1400 | | | 31 |
| 18 | 1300 | | | 29 |
| 17 | 1300 | | | 29 |
| 16 | 1200 | | | 27 |
| 15 | 1200 | | | 27 |
| 14 | 1100 | | | 27 |
| 13 | 1100 | | | 28 |
| 12 | 1000 | | 30/Sc | 27 |
| 11 | 1000 | | 30 | 27 |
| 10 | 900 | | 24 | 25 |
| 9 | 900 | | 25 | 26 |
| 8 | 800 | 23/Sq/Sc | 22 | 24 |
| 7 | 800 | 23 | 22 | 24 |
| 6 | 700 | 20 | 20 | 22 |
| 5 | 700 | 20 | 20 | 22 |
| 4 | 600 | 18 | 18 | 18 |
| 3 | 600 | 18 | 18 | 18 |
| 2 | 500 | 16 | 16 | 16 |
| 1 | 500 | 16 | 16 | 15 |

Sq = Squeal at Failure
Sc = Score Failure

TABLE 5a

| Compressor Oil AEON CL 4607 Torque (inch-pounds) | | | | |
|---|---|---|---|---|
| Minutes | Force lbs | Oil Only 0% | Plus AS-1 −50% | Plus AS-1 and HSPC-1 +150% |
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |

TABLE 5a-continued

| Compressor Oil AEON CL 4607 Torque (inch-pounds) | | | | |
|---|---|---|---|---|
| Minutes | Force lbs | Oil Only 0% | Plus AS-1 −50% | Plus AS-1 and HSPC-1 +150% |
| 20 | 1400 | | | 35/Sc |
| 19 | 1400 | | | 34 |
| 18 | 1300 | | | 29 |
| 17 | 1300 | | | 27 |
| 16 | 1200 | | | 25 |
| 15 | 1200 | | | 25 |
| 14 | 1100 | | | 23 |
| 13 | 1100 | | | 23 |
| 12 | 1000 | | | 22 |
| 11 | 1000 | | | 23 |
| 10 | 900 | | | 22 |
| 9 | 900 | | | 22 |
| 8 | 800 | 19/Sq/Sc | | 20 |
| 7 | 800 | 19 | | 20 |
| 6 | 700 | 15 | | 16 |
| 5 | 700 | 16 | | 16 |
| 4 | 600 | 14 | 20/Sq/Sc | 14 |
| 3 | 600 | 14 | 21 | 15 |
| 2 | 500 | 12 | 17 | 13 |
| 1 | 500 | 13 | 18 | 13 |

Sq = Squeal at Failure
Sc = Score Failure

TABLE 5b

| Compressor Oil AEON CL 4607 Torque (inch-pounds) | | | | | | |
|---|---|---|---|---|---|---|
| Min-utes | Force lbs | Oil Only 0% | Plus HSPC-2 −63% | Plus HSPC-5 +13% | Plus AS-4 and tween 60 +250% | Plus AS-4 and HSPC-5 and tween 60 +263% |
| 30 | 1900 | | | | | 38/Sc |
| 29 | 1900 | | | | | 36 |
| 28 | 1800 | | | | 32/Sc | 35 |
| 27 | 1800 | | | | 32 | 34 |
| 26 | 1700 | | | | 31 | 33 |
| 25 | 1700 | | | | 32 | 32 |
| 24 | 1600 | | | | 30 | 31 |
| 23 | 1600 | | | | 32 | 27 |
| 22 | 1500 | | | | 30 | 27 |
| 21 | 1500 | | | | 30 | 25 |
| 20 | 1400 | | | | 29 | 26 |
| 19 | 1400 | | | | 29 | 24 |
| 18 | 1300 | | | | 27 | 25 |
| 17 | 1300 | | | | 27 | 23 |
| 16 | 1200 | | | | 25 | 23 |
| 15 | 1200 | | | | 24 | 21 |
| 14 | 1100 | | | | 22 | 23 |
| 13 | 1100 | | | | 22 | 22 |
| 12 | 1000 | | | | 20 | 23 |
| 11 | 1000 | | | | 20 | 18 |
| 10 | 900 | | | | 18 | 18 |
| 9 | 900 | | | 20/Sq/Sc | 18 | 15 |
| 8 | 800 | 19/Sq/Sc | | 15 | 14 | 16 |
| 7 | 800 | 19 | | 15 | 14 | 14 |
| 6 | 700 | 15 | | 13 | 13 | 14 |
| 5 | 700 | 16 | | 14 | 13 | 13 |
| 4 | 600 | 14 | | 12 | 13 | 14 |
| 3 | 600 | 14 | 23/Sq/Ga | 12 | 13 | 13 |
| 2 | 500 | 12 | 19 | 10 | 12 | 14 |
| 1 | 500 | 13 | 17 | 10 | 14 | 13 |

Sq = Squeal at Failure
Ga = Gall Failure
SC = Score Failure

TABLE 6

| MSFC GL 1-140 Elevator Gear Oil Torque (inch-pounds) | | | | |
|---|---|---|---|---|
| Min | Force lbs | Oil only | Plus AS-1 +250% | Plus AS-1 and HSPC-1 +233% |
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | 48/Bo/Ga | |
| 20 | 1400 | | 42 | 38/Sc |
| 19 | 1400 | | 40 | 35 |
| 18 | 1300 | | 38 | 32 |
| 17 | 1300 | | 37 | 33 |
| 16 | 1200 | | 35 | 32 |
| 15 | 1200 | | 33 | 32 |
| 14 | 1100 | | 26 | 30/Bo |
| 13 | 1100 | | 23 | 30 |
| 12 | 1000 | | 21 | 28 |
| 11 | 1000 | | 21 | 28 |
| 10 | 900 | | 19 | 25 |
| 9 | 900 | | 19 | 25 |
| 8 | 800 | | 18 | 23 |
| 7 | 800 | | 18 | 23 |
| 6 | 700 | 25/Ga | 17 | 20 |
| 5 | 700 | 27 | 17 | 20 |
| 4 | 600 | 20 | 16 | 17 |
| 3 | 600 | 20 | 17 | 17 |
| 2 | 500 | 17 | 16 | 15 |
| 1 | 500 | 18 | 17 | 15 |

Bo = Boiling
Ga = Gall Failure
Sc = Score Failure

TABLE 7

| Tufter Machine Oil Torque (inch-pounds) | | | | |
|---|---|---|---|---|
| Min | Force lbs | Oil only | Plus AS-1 | Plus AS-1 and HSPC-1 |
| 30 | 1900 | | | |
| 29 | 1900 | | | |
| 28 | 1800 | | +300% | +533% |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |
| 20 | 1400 | | | |
| 19 | 1400 | | | 35/Sc |
| 18 | 1300 | | | 30 |
| 17 | 1300 | | | 31 |
| 16 | 1200 | | | 29 |
| 15 | 1200 | | | 28 |
| 14 | 1100 | | | 26 |
| 13 | 1100 | | | 26 |
| 12 | 1000 | | 36/Sc | 25 |
| 11 | 1000 | | 34 | 25 |
| 10 | 900 | | 31 | 24 |
| 9 | 900 | | 32 | 25 |
| 8 | 800 | | 29 | 22 |
| 7 | 800 | | 30 | 22 |
| 6 | 700 | | 29 | 18 |
| 5 | 700 | | 30 | 18 |

TABLE 7-continued

| Tufter Machine Oil Torque (inch-pounds) | | | | |
|---|---|---|---|---|
| Min | Force lbs | Oil only | Plus AS-1 | Plus AS-1 and HSPC-1 |
| 4 | 600 | | 25 | 15 |
| 3 | 600 | 23/Ga | 25 | 15 |
| 2 | 500 | 18 | 21 | 14 |
| 1 | 500 | 19 | 22 | 15 |

Ga = Gall Failure
Sc = Score Failure

TABLE 8

| Shell Dexron Mercon III ATF New and Used Torque (inch-pounds) | | | | | | | |
|---|---|---|---|---|---|---|---|
| | | NEW | | | USED | | |
| Min | Force lbs | Oil only | Plus AS-1 0% | Plus AS-1 and HSPC-1 +186% | Oil only | Plus AS-1 0% | Plus AS-1 and HSPC-1 +650% |
| 30 | 1900 | | | | | | |
| 29 | 1900 | | | | | | |
| 28 | 1800 | | | | | | |
| 27 | 1800 | | | | | | |
| 26 | 1700 | | | | | | |
| 25 | 1700 | | | | | | |
| 24 | 1600 | | | | | | |
| 23 | 1600 | | | | | | |
| 22 | 1500 | | | | | | |
| 21 | 1500 | | | | | | |
| 20 | 1400 | | | 38/Sc | | | |
| 19 | 1400 | | | 35 | | | |
| 18 | 1300 | | | 32 | | | |
| 17 | 1300 | | | 32 | | | |
| 16 | 1200 | | | 30 | | | |
| 15 | 1200 | | | 30 | | | 33/Sc |
| 14 | 1100 | | | 28 | | | 30 |
| 13 | 1100 | | | 27 | | | 29 |
| 12 | 1000 | | | 25 | | | 28 |
| 11 | 1000 | | | 25 | | | 28 |
| 10 | 900 | | | 23 | | | 26 |
| 9 | 900 | | | 23 | | | 26 |
| 8 | 800 | | | 23 | | | 25 |
| 7 | 800 | 27/Ga | 23/Ga | 23 | | | 25 |
| 6 | 700 | 23 | 18 | 21 | | | 23 |
| 5 | 700 | 24 | 18 | 21 | | | 23 |
| 4 | 600 | 20 | 16 | 19 | | | 21 |
| 3 | 600 | 21 | 16 | 19 | | | 20 |
| 2 | 500 | 18 | 15 | 16 | 17/Sq/Ga | 21/Sq/Ga | 16 |
| 1 | 500 | 19 | 15 | 16 | 17 | 21 | 15 |

Sq = Squealat Failure
Ga = Gall Failure
Sc = Score Failure

TABLE 9

NPC HT Extreme Ultima New and Used
Torque (inch-pounds)

| | | NEW | | | USED | | |
|---|---|---|---|---|---|---|---|
| Min | Force lbs | Oil Only | Plus AS-1 +140% | Plus AS-1 and HSPC- 1 +220% | Oil only +0% | Plus AS-1 +133% | Plus AS-1 and HSPC- 1 +183% |
| 30 | 1900 | | | | | | |
| 29 | 1900 | | | | | | |
| 28 | 1800 | | | | | | |
| 27 | 1800 | | | | | | |
| 26 | 1700 | | | | | | |
| 25 | 1700 | | | | | | |
| 24 | 1600 | | | | | | |
| 23 | 1600 | | | | | | |
| 22 | 1500 | | | | | | |
| 21 | 1500 | | | | | | |
| 20 | 1400 | | | | | | |
| 19 | 1400 | | | | | | |
| 18 | 1300 | | | | | | |
| 17 | 1300 | | | | | | 34/Sc |
| 16 | 1200 | | | 35/Sc | | | 30 |
| 15 | 1200 | | | 32 | | | 29 |
| 14 | 1100 | | | 30 | | 42/Sc | 26 |
| 13 | 1100 | | | 30 | | 37 | 27 |
| 12 | 1000 | | 33/Sc | 26 | | 30 | 25 |
| 11 | 1000 | | 31 | 26 | | 30 | 26 |
| 10 | 900 | | 27 | 23 | | 26 | 23 |
| 9 | 900 | | 27 | 23 | | 26 | 24 |
| 8 | 800 | | 24 | 21 | | 24 | 22 |
| 7 | 800 | | 23 | 21 | | 24 | 23 |
| 6 | 700 | | 21 | 18 | 24/Sq/Sc | 21 | 20 |
| 5 | 700 | 20/Sq/Sc | 20 | 19 | 20 | 21 | 21 |
| 4 | 600 | 17 | 17 | 15 | 16 | 18 | 18 |
| 3 | 600 | 17 | 17 | 15 | 16 | 18 | 19 |
| 2 | 500 | 15 | 15 | 13 | 14 | 16 | 15 |
| 1 | 500 | 16 | 15 | 13 | 14 | 16 | 16 |

Sq = Squeal at Failure
Sc = Score Failure

TABLE 10

40

Sullube New and Used
Torque (inch-pounds)

| | | NEW | | | USED | | |
|---|---|---|---|---|---|---|---|
| Min | Force lbs | Oil Only | Plus AS-1 and tween 60 +33% | Plus AS-1 and HSPC-1 +67% | Oil only | 45 Plus AS-1 and tween 60 +50% | Plus AS-1 and HSPC-1 +200% |
| 30 | 1900 | | | | | | |
| 29 | 1900 | | | | | 50 | |
| 28 | 1800 | | | | | | |
| 27 | 1800 | | | | | | |
| 26 | 1700 | | | | | | |
| 25 | 1700 | | | | | | |
| 24 | 1600 | | | | | | |
| 23 | 1600 | | | | | 55 | |
| 22 | 1500 | | | | | | |
| 21 | 1500 | | | | | | |
| 20 | 1400 | | | | | | |
| 19 | 1400 | | | | | | |
| 18 | 1300 | | | | | 60 | |
| 17 | 1300 | | | | | | |
| 16 | 1200 | | | | | | |
| 15 | 1200 | | | | | | |
| 14 | 1100 | | | | | | |
| 13 | 1100 | | | | | | |
| 12 | 1000 | | | | | 65 | 24/Sc |
| 11 | 1000 | | | | | | 24 |

TABLE 10-continued

| Sullube New and Used Torque (inch-pounds) | | | | | | | |
|---|---|---|---|---|---|---|---|
| | | NEW | | | USED | | |
| Min | Force lbs | Oil Only | Plus AS-1 and tween 60 +33% | Plus AS-1 and HSPC-1 +67% | Oil only | Plus AS-1 and tween 60 +50% | Plus AS-1 and HSPC-1 +200% |
| 10 | 900 | | | 20/Sq/Sc | | | 22 |
| 9 | 900 | | | 20 | | | 22 |
| 8 | 800 | | 24/Sq/Sc | 18 | | | 20 |
| 7 | 800 | | 24 | 18 | | | 21 |
| 6 | 700 | 25/Sq/Sc | 20 | 16 | | 23/Sq/Sc | 19 |
| 5 | 700 | 23 | 20 | 16 | | 23 | 20 |
| 4 | 600 | 19 | 17 | 14 | 19/Sq/Sc | 20 | 17 |
| 3 | 600 | 18 | 17 | 14 | 18 | 19 | 18 |
| 2 | 500 | 16 | 15 | 12 | 15 | 17 | 15 |
| 1 | 500 | 16 | 15 | 12 | 15 | 18 | 16 |

Sq = Squeal at Failure
Sc = Score Failure

TABLE 11

| Rotella T SAE 20 HD New and Used Torque (inch-pounds) | | | | | | | |
|---|---|---|---|---|---|---|---|
| | | | NEW | | | USED | |
| Min | Force lbs | Oil only | Plus AS-1 +150% | Plus AS-1 and HSPC-1 +450% | Oil only | Plus AS-1 +400% | Plus AS-1 and HSPC-1 +700% |
| 30 | 1900 | | | | | | |
| 29 | 1900 | | | | | | |
| 28 | 1800 | | | | | | |
| 27 | 1800 | | | | | | |
| 26 | 1700 | | | | | | |
| 25 | 1700 | | | | | | |
| 24 | 1600 | | | | | | 35/Sc |
| 23 | 1600 | | | | | | 35 |
| 22 | 1500 | | | 39/Sc | | | 33 |
| 21 | 1500 | | | 37 | | | 34 |
| 20 | 1400 | | | 34 | | | 32 |
| 19 | 1400 | | | 34 | | | 33 |
| 18 | 1300 | | | 30 | | | 31 |
| 17 | 1300 | | | 30 | | | 31 |
| 16 | 1200 | | | 28 | | | 30 |
| 15 | 1200 | | | 28 | | 32/Sc | 30 |
| 14 | 1100 | | | 27 | | 27 | 28 |
| 13 | 1100 | | | 27 | | 27 | 28 |
| 12 | 1000 | | | 25 | | 25 | 26 |
| 11 | 1000 | | | 25 | | 25 | 27 |
| 10 | 900 | | 25/Sc | 23 | | 23 | 24 |
| 9 | 900 | | 25 | 23 | | 25 | 24 |
| 8 | 800 | | 23 | 22 | | 23 | 22 |
| 7 | 800 | | 23 | 22 | | 24 | 23 |
| 6 | 700 | | 21 | 20 | | 22 | 20 |
| 5 | 700 | | 24 | 20 | | 24 | 20 |
| 4 | 600 | 23/Sc | 22 | 17 | | 23 | 17 |
| 3 | 600 | 23 | 24 | 17 | 28/Sc | 24 | 17 |
| 2 | 500 | 20 | 19 | 14 | 22 | 21 | 14 |
| 1 | 500 | 21 | 19 | 14 | 21 | 21 | 15 |

Sc = Score Failure

TABLE 12

| Shell Omala 320 New and Used Torque (inch-pounds) | | | | | | | |
|---|---|---|---|---|---|---|---|
| | | NEW | | | USED | | |
| Min | Force lbs | Oil only | Plus AS-1 −12.5% | Plus AS-1 and HSPC-1 +237.5% | Oil only | Plus AS-1 +25% | Plus AS-1 and HSPC-1 +162.5% |
| 30 | 1900 | | | | | | |
| 29 | 1900 | | | | | | |
| 28 | 1800 | | | | | | |
| 27 | 1800 | | | 36/Sc | | | |
| 26 | 1700 | | | 32/Bo | | | |
| 25 | 1700 | | | 33 | | | |
| 24 | 1600 | | | 32 | | | |
| 23 | 1600 | | | 32 | | | |
| 22 | 1500 | | | 30 | | | |
| 21 | 1500 | | | 31 | | | 36/Sc |
| 20 | 1400 | | | 30 | | | 32 |
| 19 | 1400 | | | 30 | | | 32 |
| 18 | 1300 | | | 30 | | | 30 |
| 17 | 1300 | | | 30 | | | 30 |
| 16 | 1200 | | | 28 | | | 28 |
| 15 | 1200 | | | 28 | | | 28/Bo |
| 14 | 1100 | | | 26 | | | 27 |
| 13 | 1100 | | | 26 | | | 27 |
| 12 | 1000 | | | 24 | | | 24 |
| 11 | 1000 | | | 25 | | | 24 |
| 10 | 900 | | | 23 | | 26/Sc | 23 |
| 9 | 900 | | | 23 | | 26 | 23 |
| 8 | 800 | 23/Ga | | 20 | 24/Ga | 23 | 21 |
| 7 | 800 | 23 | 25/Ga | 21 | 24 | 23 | 21 |
| 6 | 700 | 21 | 22 | 19 | 21 | 21 | 18 |
| 5 | 700 | 21 | 22 | 19 | 22 | 21 | 18 |
| 4 | 600 | 18 | 20 | 16 | 18 | 18 | 16 |
| 3 | 600 | 18 | 20 | 16 | 18 | 18 | 16 |
| 2 | 500 | 15 | 18 | 13 | 16 | 16 | 13 |
| 1 | 500 | 15 | 18 | 13 | 16 | 16 | 13 |

Ga = Gall Failure
Sc = Score Failure
Bo = Boiling

TABLE 13

| Summary of Results in Tables 1-11 of Pin and V-block Testing with AS-1 and HSPC-1 in new oils | | | | |
|---|---|---|---|---|
| | TTF | Force | Torque[1] | Torque[2] |
| Oil only | 7.2 | 773 | 23.3 | 23.3 |
| Mean ±SE | ±0.9 | ±42 | ±0.7 | ±0.7 |

TABLE 13-continued

| Summary of Results in Tables 1-11 of Pin and V-block Testing with AS-1 and HSPC-1 in new oils | | | | |
|---|---|---|---|---|
| | TTF | Force | Torque[1] | Torque[2] |
| Plus AS-1 Mean ±SE | 10.8* ±1.5 | 955* ±76 | 21.5* ±0.7 | 28.4* ±2.5 |
| Plus AS-1 and HSPC-1 Mean ±SE | 19.6*,+ ±1.7 | 1391*,+ ±88 | 20.1* ±1.0 | 33.2* ±1.8 |

TTF = time to failure, in minutes
Force = force at failure, in pounds
Torque[1] = at the time of "oil-only" failure, in inch-pounds
Torque[2] = at the time of failure, in inch-pounds
*different from "oil-only" values, $p < 0.05$
+different from "plus AS-1" values, $p < 0.05$
Values are means ± standard error (SE); n = 11

TABLE 14

| Summary of Results in Tables 7-11 of Pin and V-block Testing with AS-1 and HSPC-1 in Used Oils | | | | |
|---|---|---|---|---|
| | TTF | Force | Torque[1] | Torque[2] |
| Oil only Mean ±SE | 4.6 ±1.1 | 640 ±51 | 22.4 ±2.0 | 22.4 ±2.0 |
| Plus AS-1 Mean ±SE | 9.4* ±2.4 | 880 ±128 | 22.4 ±0.6 | 28.2 ±3.8 |
| Plus AS-1 and HSPC-1 Mean ±SE | 17.8*,+ ±2.1 | 1320*,+ ±107 | 18.2* ±1.0 | 32.4* ±2.2 |

TTF = time to failure, in minutes
Force = force at failure, in pounds
Torque[1] = at the time of "oil-only" failure, in inch-pounds
Torque[2] = at the time of failure, in inch-pounds
*different from "oil-only" values, $p < 0.05$
+different from "plus AS-1" values, $p < 0.05$
Values are means ± standard error (SE); n = 5

TABLE 15

| Hydraulic Oil DTE 25 Torque (inch-pounds) | | | | |
|---|---|---|---|---|
| Min | Force lbs | Oil only | Plus AS-1 100% | Plus AS-1 and HSPC-1 375% |
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |
| 20 | 1400 | | | |
| 19 | 1400 | | | 32/Sc |
| 18 | 1300 | | | 28 |
| 17 | 1300 | | | 28 |
| 16 | 1200 | | | 25 |
| 15 | 1200 | | | 25 |
| 14 | 1100 | | | 23 |
| 13 | 1100 | | | 23 |
| 12 | 1000 | | | 22 |
| 11 | 1000 | | | 22 |
| 10 | 900 | | | 20 |

TABLE 15-continued

| Hydraulic Oil DTE 25 Torque (inch-pounds) | | | | |
|---|---|---|---|---|
| Min | Force lbs | Oil only | Plus AS-1 100% | Plus AS-1 and HSPC-1 375% |
| 9 | 900 | | | 20 |
| 8 | 800 | | 28/Sc | 19 |
| 7 | 800 | | 30 | 19 |
| 6 | 700 | | 27 | 17 |
| 5 | 700 | | 28 | 17 |
| 4 | 600 | 26/Sc | 23 | 15 |
| 3 | 600 | 26 | 25 | 15 |
| 2 | 500 | 22 | 20 | 13 |
| 1 | 500 | 23 | 21 | 13 |

Sc = Score Failure

TABLE 16

| Tufter Hydraulic Oil Torque (inch-pounds) | | | | |
|---|---|---|---|---|
| Min | Force lbs | Oil only | Plus AS-1 | Plus AS-1 and HSPC-1 50% greater vs. plus IS-A |
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | 38/Sc |
| 22 | 1500 | | | 31 |
| 21 | 1500 | | | 31 |
| 20 | 1400 | | | 30 |
| 19 | 1400 | | | 30 |
| 18 | 1300 | | | 28 |
| 17 | 1300 | | | 28 |
| 16 | 1200 | | | 27 |
| 15 | 1200 | | 42/Sc | 27 |
| 14 | 1100 | | 37 | 25 |
| 13 | 1100 | | 35 | 26 |
| 12 | 1000 | | 32 | 24 |
| 11 | 1000 | | 33 | 24 |
| 10 | 900 | | 29 | 21 |
| 9 | 900 | | 28 | 20 |
| 8 | 800 | | 26 | 18 |
| 7 | 800 | | 26 | 18 |
| 6 | 700 | | 22 | 16 |
| 5 | 700 | | 20 | 16 |
| 4 | 600 | | 17 | 13 |
| 3 | 600 | | 17 | 13 |
| 2 | 500 | | 15 | 12 |
| 1 | 500 | 0*** | 17 | 12 |

*** = Pin Gall Failure at 0 min. 40 sec.
Sc = Score Failure

TABLE 17a

| Hydraulic Oil MilSpec 83282 Torque (inch-pounds) | | | | | | |
|---|---|---|---|---|---|---|
| Min | Force lbs | Oil only | Plus AS-1 +50% | Plus AS-1 and HSPC-1 +100% | Plus AS-1 and HSPC-3 +63% | Plus AS-1 and HSPC-7 +75% |
| 30 | 1900 | | | | | |
| 29 | 1900 | | | | | |
| 28 | 1800 | | | | | |

TABLE 17a-continued

| Hydraulic Oil MilSpec 83282 Torque (inch-pounds) | | | | | | |
|---|---|---|---|---|---|---|
| Min | Force lbs | Oil only | Plus AS-1 +50% | Plus AS-1 and HSPC-1 +100% | Plus AS-1 and HSPC-3 +63% | Plus AS-1 and HSPC-7 +75% |
| 27 | 1800 | | | | | |
| 26 | 1700 | | | | | |
| 25 | 1700 | | | | | |
| 24 | 1600 | | | | | |
| 23 | 1600 | | | | | |
| 22 | 1500 | | | | | |
| 21 | 1500 | | | | | |
| 20 | 1400 | | | | | |
| 19 | 1400 | | | | | |
| 18 | 1300 | | | | | |
| 17 | 1300 | | | | | |
| 16 | 1200 | | | 27/Bo/Sc | | |
| 15 | 1200 | | | 25 | | |
| 14 | 1100 | | | 23 | | 34/Bo/Sc |
| 13 | 1100 | | | 24 | 34/Bo/Sc | 29 |
| 12 | 1000 | | 36/Sc | 22 | 22 | 27 |
| 11 | 1000 | | 27 | 23 | 21 | 27 |
| 10 | 900 | | 23 | 20 | 20 | 25 |
| 9 | 900 | | 23 | 20 | 20 | 25 |
| 8 | 800 | 24/Sq/Sc | 22 | 18 | 18 | 21 |
| 7 | 800 | 19 | 22 | 18 | 18 | 21 |
| 6 | 700 | 19 | 20 | 16 | 16 | 19 |
| 5 | 700 | 16 | 20 | 16 | 16 | 18 |
| 4 | 600 | 17 | 16 | 14 | 13 | 14 |
| 3 | 600 | 15 | 16 | 14 | 13 | 14 |
| 2 | 500 | 16 | 13 | 12 | 11 | 12 |
| 1 | 500 | 16 | 13 | 14 | 12 | 13 |

Sq = Squeal at Failure
Bo = Boiling
Sc = Score Failure

TABLE 17b

| Min | Force lbs | Oil only | Plus AS-1 and HSPC-2 +163% | Plus AS-1 and AS-4 +75% |
|---|---|---|---|---|
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | 36/Sc | |
| 20 | 1400 | | 31 | |
| 19 | 1400 | | 32 | |
| 18 | 1300 | | 29 | |
| 17 | 1300 | | 29 | |
| 16 | 1200 | | 28 | |
| 15 | 1200 | | 29 | |
| 14 | 1100 | | 26 | 34/Bo/Sc |
| 13 | 1100 | | 25 | 30 |
| 12 | 1000 | | 24 | 29 |
| 11 | 1000 | | 23 | 29 |
| 10 | 900 | | 22 | 30 |
| 9 | 900 | | 22 | 31 |
| 8 | 800 | 24/Sq/Sc | 20 | 27 |
| 7 | 800 | 19 | 20 | 27 |
| 6 | 700 | 19 | 17 | 22 |
| 5 | 700 | 16 | 17 | 20 |
| 4 | 600 | 17 | 14 | 17 |
| 3 | 600 | 15 | 14 | 17 |

TABLE 17b-continued

| Min | Force lbs | Oil only | Plus AS-1 and HSPC-2 +163% | Plus AS-1 and AS-4 +75% |
|---|---|---|---|---|
| 2 | 500 | 16 | 11 | 14 |
| 1 | 500 | 16 | 12 | 20 |

Sq = Squeal at Failure
Bo = Boiling
Sc = Score Failure

TABLE 18

| Hydraulic Oil MilSpec 83282 Torque (inch-pounds) | | | |
|---|---|---|---|
| Min | Force lbs | Oil only | Plus AS-2 and HSPC-4 +50% |
| 30 | 1900 | | |
| 29 | 1900 | | |
| 28 | 1800 | | |
| 27 | 1800 | | |
| 26 | 1700 | | |
| 25 | 1700 | | |
| 24 | 1600 | | |
| 23 | 1600 | | |
| 22 | 1500 | | |
| 21 | 1500 | | |
| 20 | 1400 | | |
| 19 | 1400 | | |
| 18 | 1300 | | |
| 17 | 1300 | | |
| 16 | 1200 | | |
| 15 | 1200 | | |
| 14 | 1100 | | |
| 13 | 1100 | | |
| 12 | 1000 | | 25/Sq/Sc |
| 11 | 1000 | | 25 |
| 10 | 900 | | 20 |
| 9 | 900 | | 21 |
| 8 | 800 | 24/Sq/Sc | 17 |
| 7 | 800 | 19 | 17 |
| 6 | 700 | 19 | 15 |
| 5 | 700 | 16 | 15 |
| 4 | 600 | 17 | 13 |
| 3 | 600 | 15 | 13 |
| 2 | 500 | 16 | 12 |
| 1 | 500 | 16 | 12 |

Sq = Squeal at Failure
Sc = Score Failure

TABLE 19

| Hydraulic Oil MilSpec 83282 Torque (inch-pounds) | | | | |
|---|---|---|---|---|
| Min | Force lbs | Oil only | Plus AS-3 +13% | Plus AS-3 and sodium dodecyl sulfate +75% |
| 30 | 1900 | | | |
| 29 | 1900 | | | |
| 28 | 1800 | | | |
| 27 | 1800 | | | |
| 26 | 1700 | | | |
| 25 | 1700 | | | |
| 24 | 1600 | | | |
| 23 | 1600 | | | |
| 22 | 1500 | | | |
| 21 | 1500 | | | |
| 20 | 1400 | | | |
| 19 | 1400 | | | |
| 18 | 1300 | | | |

TABLE 19-continued

| Hydraulic Oil MilSpec 83282 Torque (inch-pounds) | | | | |
|---|---|---|---|---|
| Min | Force lbs | Oil only | Plus AS-3 +13% | Plus AS-3 and sodium dodecyl sulfate +75% |
| 17 | 1300 | | | |
| 16 | 1200 | | | |
| 15 | 1200 | | | |
| 14 | 1100 | | | 42/Sc |
| 13 | 1100 | | | 27 |
| 12 | 1000 | | | 35 |
| 11 | 1000 | | | 33 |
| 10 | 900 | | | 27 |
| 9 | 900 | | 30/Sq/Sc | 24 |
| 8 | 800 | 24/Sq/Sc | 21 | 20 |
| 7 | 800 | 19 | 20 | 19 |
| 6 | 700 | 19 | 17 | 17 |
| 5 | 700 | 16 | 17 | 16 |
| 4 | 600 | 17 | 15 | 14 |
| 3 | 600 | 15 | 15 | 14 |
| 2 | 500 | 16 | 13 | 12 |
| 1 | 500 | 16 | 13 | 13 |

Sq = Squeal at Failure
Sc = Score Failure

TABLE 20

| Hydraulic Oil MilSpec 83282 Torque (inch-pounds) | | | | | | |
|---|---|---|---|---|---|---|
| Min | Force lbs | Oil only | Plus HSPC-1 +25% | HSPC-2 0% | Plus HSPC-7 0% | Plus HSPC-5 −13% |
| 30 | 1900 | | | | | |
| 29 | 1900 | | | | | |
| 28 | 1800 | | | | | |
| 27 | 1800 | | | | | |
| 26 | 1700 | | | | | |
| 25 | 1700 | | | | | |
| 24 | 1600 | | | | | |
| 23 | 1600 | | | | | |
| 22 | 1500 | | | | | |
| 21 | 1500 | | | | | |
| 20 | 1400 | | | | | |
| 19 | 1400 | | | | | |
| 18 | 1300 | | | | | |
| 17 | 1300 | | | | | |
| 16 | 1200 | | | | | |
| 15 | 1200 | | | | | |
| 14 | 1100 | | | | | |
| 13 | 1100 | | | | | |
| 12 | 1000 | | | | | |
| 11 | 1000 | | | | | |
| 10 | 900 | | 24/Ga | | | |
| 9 | 900 | | 20 | | | |
| 8 | 800 | 24/Sq/Sc | 17 | 22/Sq/Sc | 19/Sq/Sc | |
| 7 | 800 | 19 | 17 | 20 | 19 | 28/Sq/Sc |

TABLE 20-continued

| Hydraulic Oil MilSpec 83282 Torque (inch-pounds) | | | | | | |
|---|---|---|---|---|---|---|
| Min | Force lbs | Oil only | Plus HSPC-1 +25% | HSPC-2 0% | Plus HSPC-7 0% | Plus HSPC-5 −13% |
| 6 | 700 | 19 | 15 | 18 | 18 | 16 |
| 5 | 700 | 16 | 16 | 17 | 17 | 17 |
| 4 | 600 | 17 | 15 | 16 | 16 | 14 |
| 3 | 600 | 15 | 15 | 16 | 16 | 15 |
| 2 | 500 | 16 | 13 | 14 | 13 | 13 |
| 1 | 500 | 16 | 14 | 14 | 13 | 13 |

Sq = Squeal at Failure
Bo = Boiling
Ga = Gall Failure
Sc = Score Failure

TABLE 21

| Supertech Antifreeze Torque (inch-pounds) | | | | |
|---|---|---|---|---|
| Min | Force lbs | Antifreeze only | Plus AS-1 | Plus AS-1 and HSPC-1 |
| 30 | 1900 | | +700% | +2600% |
| 29 | 1900 | | | |
| 28 | 1800 | | | |
| 27 | 1800 | | | |
| 26 | 1700 | | | 47/Bo/Sc |
| 25 | 1700 | | | 45 |
| 24 | 1600 | | | 44 |
| 23 | 1600 | | | 43 |
| 22 | 1500 | | | 42 |
| 21 | 1500 | | | 40 |
| 20 | 1400 | | | 41 |
| 19 | 1400 | | | 42 |
| 18 | 1300 | | | 40 |
| 17 | 1300 | | | 40 |
| 16 | 1200 | | | 40 |
| 15 | 1200 | | | 41 |
| 14 | 1100 | | | 39 |
| 13 | 1100 | | | 40 |
| 12 | 1000 | | | 39 |
| 11 | 1000 | | | 40 |
| 10 | 900 | | | 40 |
| 9 | 900 | | | 41 |
| 8 | 800 | | 54/Bo/Sc | 40 |
| 7 | 800 | | 60 | 44 |
| 6 | 700 | | 59 | 44 |
| 5 | 700 | | 61 | 47 |
| 4 | 600 | | 58 | 46 |
| 3 | 600 | | 59 | 46 |
| 2 | 500 | | 47 | 39 |
| 1 | 500 | 49/Sc | 40 | 34 |

Bo = Boiling
Sc = Score Failure

TABLE 22

| Deionized Water Torque (inch-pounds) | | | | | | | |
|---|---|---|---|---|---|---|---|
| Min | Force lbs | Water only | Plus tween 60 | Plus HSPC-6 and tween 60 | Plus AS-1 | Plus HSPC-1 | Plus AS-1 and HSPC-1 |
| 32 | 2000 | | | | | | 53/Sc |
| 31 | 2000 | | | | | | 51 |
| 30 | 1900 | | | | | | 46 |
| 29 | 1900 | | | 60/Sc | | | 46 |
| 28 | 1800 | | | 55 | | | 43 |
| 27 | 1800 | | | 51 | | | 44 |

TABLE 22-continued

| Deionized Water Torque (inch-pounds) | | | | | | | |
|---|---|---|---|---|---|---|---|
| Min | Force lbs | Water only | Plus tween 60 | Plus HSPC-6 and tween 60 | Plus AS-1 | Plus HSPC-1 | Plus AS-1 and HSPC-1 |
| 26 | 1700 | | | 46 | | 60/Sc | 41 |
| 25 | 1700 | | | 49 | | 54 | 40 |
| 24 | 1600 | | | 46 | | 48 | 39 |
| 23 | 1600 | | | 43 | | 45 | 41 |
| 22 | 1500 | | | 39 | | 43 | 37 |
| 21 | 1500 | | | 39 | | 41 | 37/Bo |
| 20 | 1400 | | | 37 | | 39 | 35 |
| 19 | 1400 | | | 37 | | 38 | 36 |
| 18 | 1300 | | | 36 | | 36 | 33 |
| 17 | 1300 | | | 36 | | 36 | 34 |
| 16 | 1200 | | | 34 | | 34 | 32 |
| 15 | 1200 | | | 34 | | 33 | 32 |
| 14 | 1100 | | | 32 | | 32 | 30 |
| 13 | 1100 | | | 33 | | 32 | 30 |
| 12 | 1000 | | | 31 | | 29 | 28 |
| 11 | 1000 | | | 32 | | 30 | 29 |
| 10 | 900 | | | 28 | | 26 | 26 |
| 9 | 900 | | | 29 | | 27 | 27 |
| 8 | 800 | | | 25 | | 24 | 24 |
| 7 | 800 | | | 26 | | 24 | 25 |
| 6 | 700 | | | 21 | | 21 | 22 |
| 5 | 700 | | | 22 | | 22 | 22 |
| 4 | 600 | | | 18 | | 19 | 19 |
| 3 | 600 | | | 18 | | 19 | 19 |
| 2 | 500 | | 20/Sq/Sc | 14 | | 16 | 16 |
| 1 | 500 | $0^1$/Ga | 20 | 14 | $0^2$/Ga | 18 | 16 |

Sq = Squeal at Failure
Sc = Score Failure
Ga = Gall Failure
Bo = Boiling
$0^1$ = Failure before reaching the 500 lb mark
$0^2$ = Failure at 0 min. 10 sec.

The invention claimed is:

1. A process for formulating a boundary layer organizer targeting frictional boundaries for lubrication thereof, comprising the steps of:

1) providing one or more single-phase compounds as one or more boundary layer organizers;
2) providing an anti-wear and/or anti-friction aqueous salt solution, wherein said salts in said aqueous salt solution are inorganic salts; and
3) forming a mixture of said one or more single-phase compounds, said aqueous salt solution, and a lubricating fluid, thereby forming an emulsion in said lubricating fluid, wherein said emulsion is targeted to frictional surfaces whereon said emulsion interacts with said frictional surfaces to organize boundary layers through thermodynamic targeting.

2. The process of claim 1 wherein said single-phase compound comprises one or more imidazolium-based ionic liquids.

3. The process of claim 1 wherein said boundary layer organizer is selected from the group consisting of castor oil, sulfonated castor oil, ethoxylated castor oil, lanolin, triethylamine, 1-octyl-3-methylimidazoliumbis(trifluoromethylsulfonyl)imide, 1-dodecyl-3-methyl-imidazoliumbis(trifluoromethylsulfonyl)imide, and 1-butyl-3-methylimidazoliumbis(trifluoromethylsulfonyl)imide, or combinations thereof.

4. The process of claim 1 wherein said boundary layer organizer thermodynamically targets said frictional boundaries and said boundary layers, and wherein said thermodynamic targeting is in accord with the Second Law of Thermodynamics.

5. The process of claim 1 wherein said boundary layer organizer is hydrophobic relative to said lubricating fluid.

6. The process of claim 1 wherein said boundary layer organizer is hydrophilic relative to said lubricating fluid.

7. The process of claim 1 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

8. The process of claim 1 wherein said one or more single-phase compounds and said aqueous salt solution are combined in a ratio of 1 part to 5 parts by volume or 5 parts to 1 part by volume or in a ratio therebetween.

9. The process of claim 7 wherein said non-hydroxy metal compounds in said aqueous salt solution are boric acid and zinc oxide.

10. A process for formulating a boundary layer organizer thermodynamically targeting frictional boundaries for lubrication thereof, comprising the steps of:

1) providing one or more single-phase compounds as one or more boundary layer organizers, wherein said boundary layer organizer is selected from the group consisting of castor oil, sulfonated castor oil, ethoxylated castor oil, lanolin, triethylamine, 1-octyl-3-methylimidazoliumbis(trifluoromethylsulfonyl)imide, 1-dodecyl-3-methyl-imidazoliumbis(trifluoromethylsulfonyl)imide, and 1-butyl-3-methylimidazolium-bis(trifluoromethylsulfonyl)imide, or combinations thereof;
2) providing an anti-wear and/or anti-friction aqueous salt solution, wherein said salts in said aqueous salt solution are inorganic salts; and 3) forming a mixture of said one or more single-phase compounds, said aqueous salt solution, and a lubricating fluid, thereby forming an emulsion in said lubricating fluid, wherein said emulsion is targeted to frictional surfaces whereon said emulsion interacts with said frictional surfaces to organize boundary layers through thermodynamic targeting, and wherein said one or more single-phase compounds and said aqueous salt solution are combined in a ratio of 1 part to 5 parts by volume or 5 parts to 1 part by volume or in a ratio therebetween.

11. The process of claim 10 wherein said single-phase compound comprises one or more imidazolium-based ionic liquids.

12. The process of claim 10 wherein said boundary layer organizer thermodynamically targets said frictional boundaries and said boundary layers.

13. The process of claim 10 wherein said boundary layer organizer is hydrophobic relative to said lubricating fluid, where said lubricating fluid is water-based.

14. The process of claim 10 wherein said boundary layer organizer is hydrophilic relative to said lubricating fluid, where said lubricating fluid is oil-based.

15. The process of claim 10 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

16. The process of claim 15 wherein said non-hydroxy metal compounds in said aqueous salt solution are boric acid and zinc oxide.

17. The process of claim 1 wherein said process forms a lubricating fluid, comprising:

a) a hydrophobic lubricating fluid, wherein said hydrophobic lubricating fluid is oil-based;

b) one or more single-phase compounds, wherein said single-phase compound is selected from the group consisting of castor oil, sulfonated castor oil, ethoxylated castor oil, lanolin, triethylamine, 1-octyl-3-methylimidazoliumbis-(trifluoromethylsulfonyl)imide, 1-dodecyl-3-methyl-imidazoliumbis-(trifluoromethylsulfonyl)imide, and 1-butyl-3-methylimidazolium-bis (trifluoromethylsulfonyl)imide, or combinations thereof; and c) an anti-wear and/or anti-friction aqueous salt solution, wherein said salts in said aqueous salt solution are inorganic salts, wherein the combination of said one or more single-phase compounds and said aqueous salt solution form an emulsion in said hydrophobic oil, and wherein said one or more single-phase compounds and said aqueous salt solution are combined in a ratio of 1 part to 5 parts by volume or 5 parts to 1 part by volume or in a ratio therebetween.

18. The process of claim 17 wherein said aqueous salt solution consists of salts formulated such that, when said aqueous salt solution is coated on a surface, said aqueous salt solution forms a conversion coating on said surface without the application of external electromotive force.

19. The process of claim 17 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

20. The process of claim 19 wherein said non-hydroxy metal compounds in said aqueous salt solution are boric acid and zinc oxide.

21. The process of claim 1 wherein said process forms a lubricating fluid, comprising:

a) a hydrophilic lubricating fluid, wherein said hydrophilic lubricating fluid is water-based;

b) one or more single-phase compounds, wherein said single-phase compound is selected from the group consisting of castor oil, sulfonated castor oil, ethoxylated castor oil, lanolin, triethylamine, 1-octyl-3-methylimidazoliumbis-(trifluoromethylsulfonyl)imide, 1-dodecyl-3-methyl-imidazoliumbis-(trifluoromethylsulfonyl)imide, and 1-butyl-3-methylimidazolium-bis (trifluoromethylsulfonyl)imide, or combinations thereof; and c) an anti-wear and/or anti-friction aqueous salt solution, wherein said salts in said aqueous salt solution are inorganic salts, wherein the combination of said one or more single-phase compounds and said aqueous salt solution form an emulsion in said hydrophobic oil, and wherein said one or more single-phase compounds and said aqueous salt solution are combined in a ratio of 1 part to 5 parts by volume or 5 parts to 1 part by volume or in a ratio therebetween.

22. The process of claim 21 wherein said aqueous salt solution consists of salts formulated such that, when said aqueous salt solution is coated on a surface, said aqueous salt solution forms a conversion coating on said surface without the application of external electromotive force.

23. The process of claim 21 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

24. The process of claim 23 wherein said non-hydroxy metal compounds in said aqueous salt solution are boric acid and zinc oxide.

25. A process for formulating a boundary layer organizer targeting frictional boundaries for lubrication thereof, comprising the steps of:

1) providing one or more single-phase compounds as one or more boundary layer organizers, wherein said one or more single-phase compounds are not resins;

2) providing an anti-wear and/or anti-friction aqueous salt solution, wherein said salts in said aqueous salt solution are inorganic salts; and 3) forming a mixture of said one or more single-phase compounds, said aqueous salt solution, and a lubricating fluid, thereby forming a stable emulsion in said lubricating fluid, wherein said lubricating fluid forms greater than 20% by volume of said mixture and wherein said emulsion is targeted to frictional surfaces whereon said emulsion interacts with said frictional surfaces to organize boundary layers through thermodynamic targeting.

26. The process of claim 25 wherein said single-phase compound comprises one or more imidazolium-based liquids.

27. The process of claim 25 wherein said boundary layer organizer is selected from the group consisting of castor oil, sulfonated castor oil, ethoxylated castor oil, lanolin, triethylamine, 1-octyl-3-methylimidazoliumbis(trifluoromethylsulfonyl)imide, 1-dodecyl-3-methyl-imidazoliumbis(trifluoromethylsulfonyl)imide, and 1-butyl-3-methylimidazoliumbis(trifluoromethylsulfonyl)imide, or combinations thereof.

28. The process of claim 25 wherein said boundary layer organizer thermodynamically targets said frictional boundaries and said boundary layers, and wherein said thermodynamic targeting is in accord with the Second Law of Thermodynamics.

29. The process of claim 25 wherein said boundary layer organizer is hydrophobic relative to said lubricating fluid.

30. The process of claim 25 wherein said boundary layer organizer is hydrophilic relative to said lubricating fluid.

31. The process of claim 25 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

32. The process of claim 25 wherein said one or more single-phase compounds and said aqueous salt solution are combined in a ratio of 1 part to 5 parts by volume or 5 parts to 1 part by volume or in a ratio therebetween.

33. The process of claim 31 wherein said non-hydroxy metal compounds in said aqueous salt solution are boric acid and zinc oxide.

34. A process for formulating a boundary layer organizer thermodynamically targeting frictional boundaries for lubrication thereof, comprising the steps of:

1) providing one or more single-phase compounds as one or more boundary layer organizers, wherein said boundary layer organizer is selected from the group consisting of castor oil, sulfonated castor oil, ethoxylated castor oil, lanolin, triethylamine, 1-octyl-3-methylimidazoliumbis (trifluoromethylsulfonyl)imide, 1-dodecyl-3-methylimidazoliumbis(trifluoromethylsulfonyl)imide, and 1-butyl-3-methylimidazolium-bis(trifluoromethylsulfonyl)imide, or combinations thereof;
2) providing an anti-wear and/or anti-friction aqueous salt solution, wherein said salts in said aqueous salt solution are inorganic salts; and
3) forming a mixture of said one or more single-phase compounds, said aqueous salt solution, and a lubricating fluid, thereby forming a stable emulsion in said lubricating fluid, wherein said lubricating fluid forms greater than 20% by volume of said mixture, wherein said emulsion is targeted to frictional surfaces whereon said emulsion interacts with said frictional surfaces to organize boundary layers through thermodynamic targeting, and wherein said one or more single-phase compounds and said aqueous salt solution are combined in a ratio of 1 part to 5 parts by volume or 5 parts to 1 part by volume or in a ratio therebetween.

35. The process of claim 34 wherein said single-phase compound comprises one or more imidazolium-based ionic liquids.

36. The process of claim 34 wherein said boundary layer organizer thermodynamically targets said frictional boundaries and said boundary layers.

37. The process of claim 34 wherein said boundary layer organizer is hydrophobic relative to said lubricating fluid, where said lubricating fluid is water-based.

38. The process of claim 34 wherein said boundary layer organizer is hydrophilic relative to said lubricating fluid, where said lubricating fluid is oil-based.

39. The process of claim 34 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

40. The process of claim 39 wherein said non-hydroxy metal compounds in said aqueous salt solution are boric acid and zinc oxide.

41. The process of claim 25 wherein said process forms a lubricating fluid, comprising:

a) a hydrophobic lubricating fluid, wherein said hydrophobic lubricating fluid is oil-based;
b) one or more single-phase compounds, wherein said single-phase compound is selected from the group consisting of castor oil, sulfonated castor oil, ethoxylated castor oil, lanolin, triethylamine, 1-octyl-3-methylimidazoliumbis-(trifluoromethylsulfonyl)imide, 1-dodecyl-3-methyl-imidazoliumbis-(trifluoromethylsulfonyl)imide, and 1-butyl-3-methylimidazolium-bis (trifluoromethylsulfonyl)imide, or combinations thereof; and
c) an anti-wear and/or anti-friction aqueous salt solution, wherein said salts in said aqueous salt solution are inorganic salts, wherein the combination of said one or more single-phase compounds and said aqueous salt solution form an emulsion in said hydrophobic oil, and wherein said one or more single-phase compounds and said aqueous salt solution are combined in a ratio of 1 part to 5 parts by volume or 5 parts to 1 part by volume or in a ratio therebetween.

42. The process of claim 41 wherein said aqueous salt solution consists of salts formulated such that, when said aqueous salt solution is coated on a surface, said aqueous salt solution forms a conversion coating on said surface without the application of external electromotive force.

43. The process of claim 41 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

44. The process of claim 43 wherein said non-hydroxy metal compounds in said aqueous salt solution are boric acid and zinc oxide.

45. The process of claim 25 wherein said process forms a lubricating fluid, comprising:

a) a hydrophilic lubricating fluid, wherein said hydrophilic lubricating fluid is water-based;
b) one or more single-phase compounds, wherein said single-phase compound is selected from the group consisting of castor oil, sulfonated castor oil, ethoxylated castor oil, lanolin, triethylamine, 1-octyl-3-methylimidazoliumbis-(trifluoromethylsulfonyl)imide, 1-dodecyl-3-methyl-imidazoliumbis-(trifluoromethylsulfonyl)imide, and 1-butyl-3-methylimidazolium-bis (trifluoromethylsulfonyl)imide, or combinations thereof; and
c) an anti-wear and/or anti-friction aqueous salt solution, wherein said salts in said aqueous salt solution are inorganic salts, wherein the combination of said one or more single-phase compounds and said aqueous salt solution form an emulsion in said hydrophobic oil, and wherein said one or more single-phase compounds and said aqueous salt solution are combined in a ratio of 1 part to 5 parts by volume or 5 parts to 1 part by volume or in a ratio therebetween.

46. The process of claim 45 wherein said aqueous salt solution consists of salts formulated such that, when said aqueous salt solution is coated on a surface, said aqueous salt solution forms a conversion coating on said surface without the application of external electromotive force.

47. The process of claim 45 wherein said aqueous salt solution contains two or more non-hydroxy metal compounds wherein said non-hydroxy metal is selected from Groups I-VII of the Periodic Table, and wherein said aqueous salt solution comprises salts obtained from separate acid-base reactions of sulfuric acid or phosphoric acid with ammonium hydroxide and alkali metal hydroxide.

48. The process of claim 47 wherein said non-hydroxy metal compounds in said aqueous salt solution are boric acid and zinc oxide.

* * * * *